US005316503A

United States Patent [19]

Thompson et al.

[11] Patent Number: 5,316,503

[45] Date of Patent: May 31, 1994

[54] ELECTRICAL CONNECTORS

[75] Inventors: Ray Thompson, Dudley; Robert W. Taylor, Chipstead, both of Great Britain

[73] Assignee: Cliff Electronic Components Limited, Surrey, United Kingdom

[21] Appl. No.: 977,766

[22] Filed: Nov. 17, 1992

[30] Foreign Application Priority Data

Nov. 18, 1991 [GB] United Kingdom ..... 9124465

[51] Int. Cl.[5] ..... H01R 13/42

[52] U.S. Cl. ..... 439/740; 29/845

[58] Field of Search ..... 439/740, 752; 29/845

[56] References Cited

U.S. PATENT DOCUMENTS 3,031,639 4/1962 Majewski ..... 439/740
3,122,407 2/1964 Cowe ..... 439/740
4,304,457 12/1981 Lissau ..... 439/740 X

*Primary Examiner*—Eugene F. Desmond

[57] ABSTRACT

An electrical connector has an insulating body 30 with longitudinal chambers 45, 46 and 47 running through it. Electrical contact elements 81, 82 and 83 are received one each in the chambers. Each chamber has projections $\alpha$ and $\beta$ and each contact element has a rebate 86. Rotation of the contact element in the chamber relative to the body from an initial orientation to a second orientation engages the rebate 86 with the projections $\alpha$ and $\beta$ to restrain the elements from longitudinal displacement relative to the body. Projections 50 on the external face of the body 30 can engage an external portion of the contact element when that element is rotated to its second orientation to retain the element from rotating relative to the body. The connector can be a plug or a socket. A corresponding method of assembling an electrical connector is described.

18 Claims, 4 Drawing Sheets

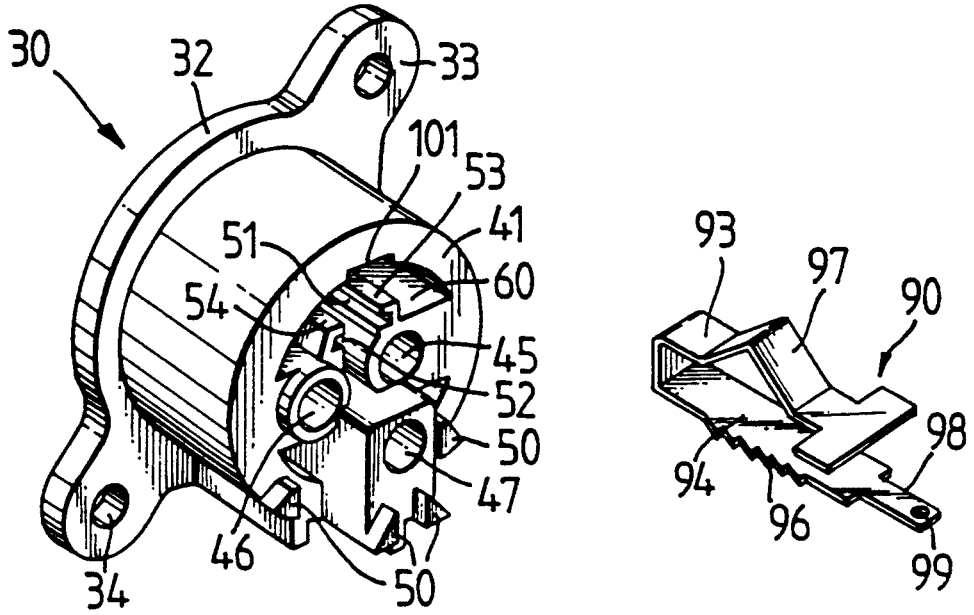
FIG. 1.
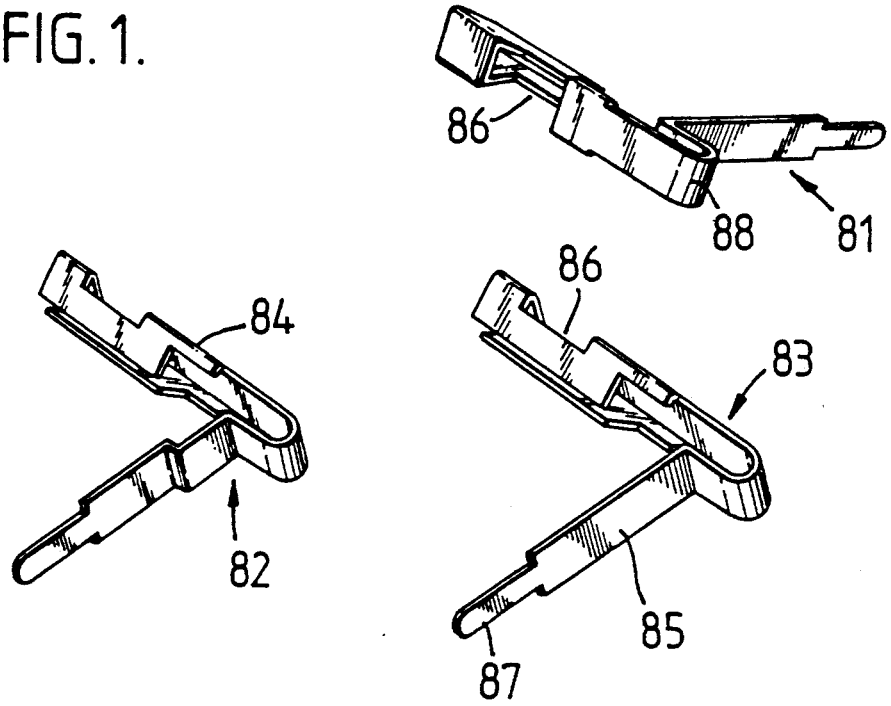

ELECTRICAL CONNECTORS

This invention concerns electrical connectors and their method of manufacture, and is primarily concerned with electrical sockets or electrical plugs.

Electrical connectors as known having an insulating body which carries one or more contact elements of predetermined size and disposition which are arranged in use to be received in an electrical socket or to receive pins of an electrical plug for making electrical contact between the plug and socket. Typically, such electrical connectors are used in audio electronics and generally comprise moulded rigid plastics bodies in which the electrical contact elements are retained by frictional engagement. An example of such an electrical connector is disclosed in Patent Specification GB 2185157A.

A disadvantage of such known constructions is that a friction fit does not positively restrain the contact elements from inadvertently becoming displaced from the body. It is an object of the present invention to provide an electrical connector and method of assembling such a connector which alleviates the aforementioned disadvantage and by which the connector may be assembled easily and relatively inexpensively with its contact elements mechanically secured in body.

According to the present invention there is provided an electrical connector comprising a body in which an electrical contact element is retained in a longitudinal chamber extending within the body, said body having a first retaining means which engages a second retaining means on the contact element when received in the chamber, said engagement between the first and second retaining means being effected by inserting the element longitudinally into the chamber in a first orientation and rotating the element about its longitudinal axis and relative to the body to a second orientation in which the contact element is restrained from longitudinal displacement relative to the body.

Usually the connector will have two or more of the contact elements retained by respectively associated first and second retaining means in a spaced array of chambers in the body within which the elements are respectively received.

Preferably the first retaining means is located within the chamber in the body.

With advantage, a third retaining means is positioned on an external face of the body and an extension of the contact element, in its second orientation, is engagable with or engages the third retaining means to restrain said element from rotation relative to the body. The third retaining means conveniently comprises a clip portion on the body with which the element extension engages in its second orientation or as it is rotated from its first to its second orientation.

Preferably, one of the first or second retaining means comprises a projection and the other of said retaining means comprising a rebate corresponding to the projection and which are moved into engagement by rotation of the contact element from its first to its second orientation, said engagement between the rebate and projection retaining the element from longitudinal displacement within the body.

The electrical contact element may comprise a longitudinal portion received within the chamber, and an extension or terminal portion which projects from the chamber. The terminal portion may extend, for example, at right angles to the longitudinal portion to fit against an external face of body when contact element is in its second orientation. The terminal portion may be in the form of a loop extending from the body to facilitate connection of an electrical lead thereto.

Preferably, the contact element, or the aforementioned longitudinal portion thereof, which is received in the chamber is substantially triangular in lateral section with a longitudinally extending rebate formed along at least one apex of the triangular formation so that the longitudinal rebate or rebates will interengage with a corresponding rib or ribs in the chamber as the contact element is rotated from its first orientation to its second orientation. The triangular formation of the element may be hollow, for example, to receive an electrical pin of a plug mated therewith, or may be solid, for example, to extend to include an electrical pin for mating with a socket. It will be appreciated, however, that the contact element, or the portion thereof within the chamber, can be of different longitudinal shapes from the aforementioned triangular formation with appropriately located rebates and projections between the body and element which provide the required interengagment and retention of the element when the latter is rotated to its second orientation. For example, the contact element may be of a polygonal lateral section other than triangular with rebates in its longitudinal edges (presented by convergent flat faces) appropriately disposed for engagement with complimentary ribs in the chamber during the required rotation of the contact element.

Where the body includes a plurality of chambers, they or the contact elements which they receive may be of varying length, so that the aforementioned angled extension portions of the contact elements received therein can extend in parallel, but different, planes. Furthermore the extension portions of the contact elements may differ in length such that the free ends or tips of these portions can lie in a common plane when contact elements are fitted in body.

Further according to the present invention there is provided a method of assembling an electrical connector having an insulating body and a longitudinal chamber therein opening to a rear face of the body and in which said chamber receives an electrical contact element which comprises inserting the contact element longitudinally into the chamber in a first orientation and rotating said element about its longitudinal axis and relative to the body to a second orientation in which first retaining means on the element engages second retaining means on the body for said engagement to restrain the element from longitudinal displacement relative to the body.

Embodiments of an electrical connector constructed in accordance with the present invention will now be described, by way of example only, with reference to the accompanying illustrative drawings in which:

FIG. 1 is a perspective view of an electrical socket body with the contact elements to be fitted thereto for assembly of an electrical socket.

Figure 3A:
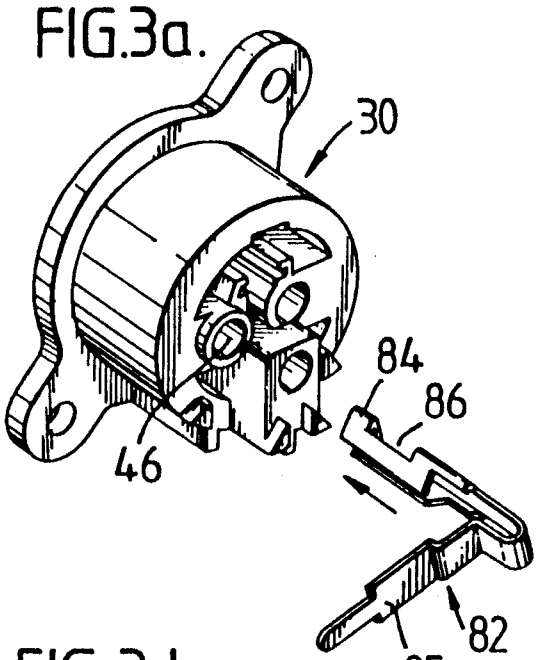
Figure 3B:
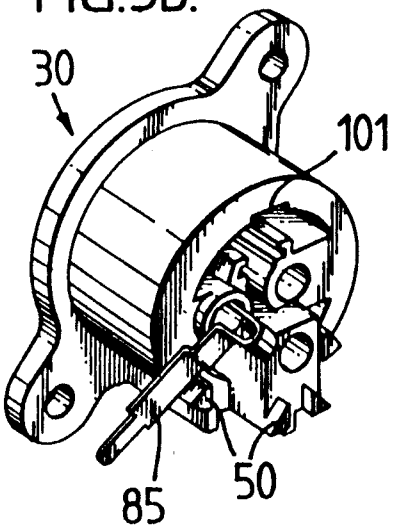
Figure 3C:
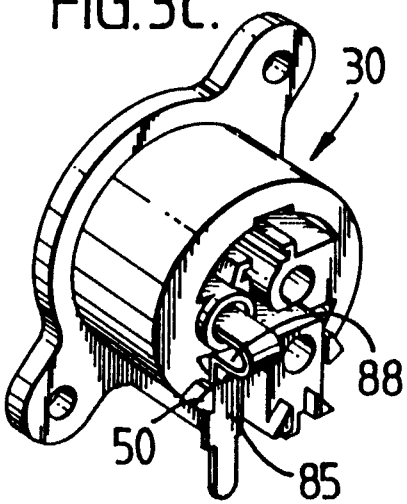

FIGS. 3*a*, 3*b* and 3*c* diagrammatically and sequentially illustrate the fitting of the contact elements of FIG. 1 and FIGS. 3*d*, 3*e* and 3*f* the corresponding sequential engagement of the retaining means.

Figure 4:
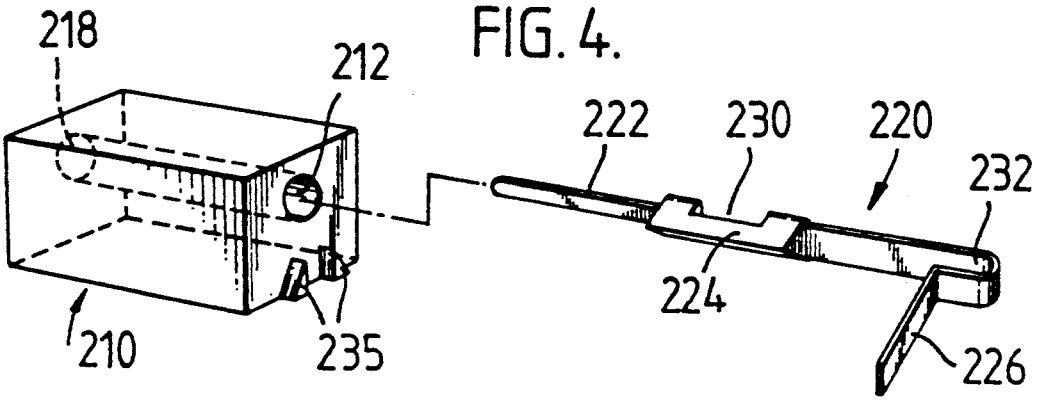
Figure 5A:
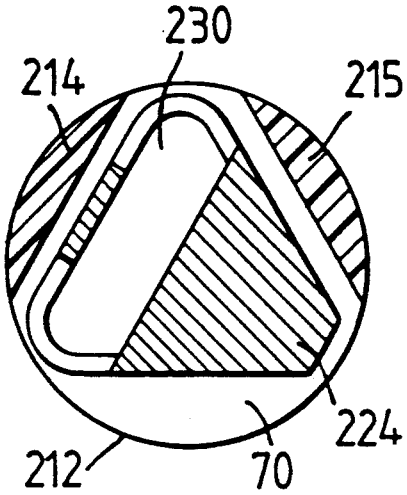
Figure 5B:
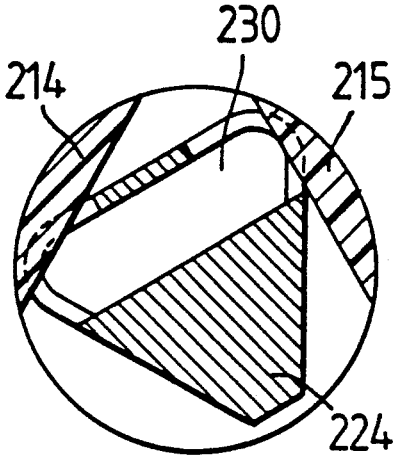
Figure 5C:
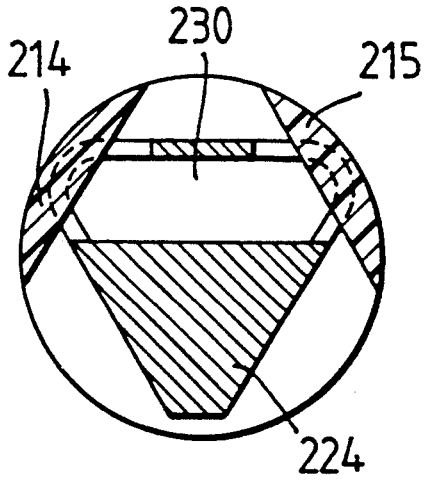

FIG. 4 is a perspective view of an electrical plug body with a contact element to be fitted thereto for assembly of an electrical plug, and FIGS. 5*a*, 5*b* and 5*c* diagrammatically and sequentially illustrate the engagement of the contact element with the plug body of FIG. 4.

The first embodiment of the invention described herein is an electrical socket for use with an electrical plug, the latter being of a form commonly available comprising three metal connector pins contained in and projecting from a block of moulded plastics. The pins are positioned at the apices of a notional triangle. The plastic block may be carried in a cylindrical metal shell which projects from the block to form a skirt around the three pins, the skirt often has a shallow groove in its inner surface at a predetermined orientation to the pin arrangement. This is a common type of plug and it will be appreciated that there are various ways in which similar plugs may be formed to fit a common socket.

A socket constructed in accordance with the present invention to receive a plug as described above comprises a moulded body 30 of an insulating material. The body 30 is generally of cylindrical form with a circumferential flange 32 adjacent one end front face 61 thereof. The flange 32 has ears 33 containing apertures 34 through which screws or bolts may be passed to secure the socket to an appropriate casing.

Figure 2A:
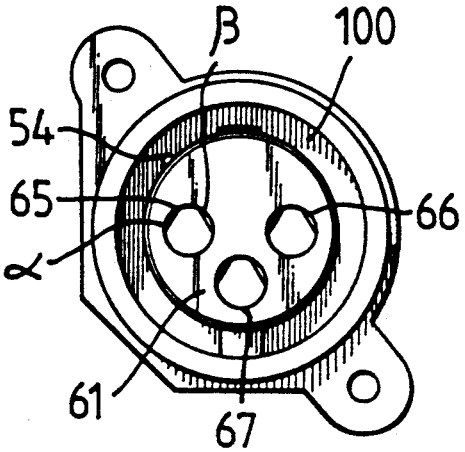
FIGS. 2A–2C show front, side sectional and rear views, A, B & C respectively, of the socket body of FIG. 1.
Figure 2B:
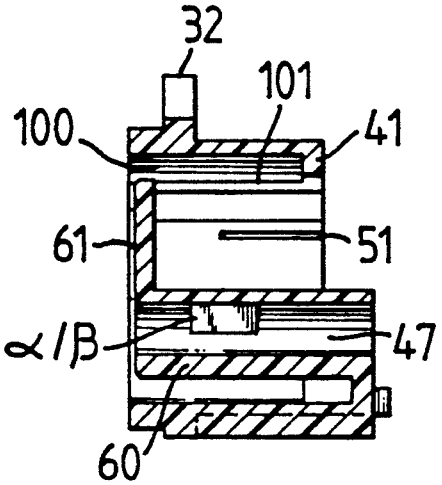
Figure 2C:
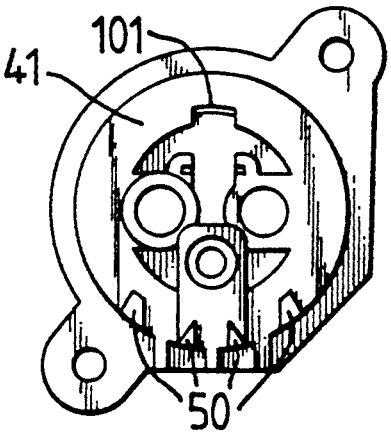

The body 30 has a co-axial annular recess 100 (FIGS. 2A and 2B) which extends from the front face 61 rearwardly part way through the body towards a rear face 41 of the body. This recess is designed to receive the previously mentioned skirt of a corresponding plug.

The recess 100 forms a core section of the socket body 30, the front face 61 of which has three apertures 65, 66 and 67 opening to three chambers 45, 46 and 47 which extend longitudinally through the body to open in its rear face 41.

The core section of the socket body is predominantly hollow as seen in FIG. 1 to define the three generally tubular walled chambers 45, 46 and 47. The chambers 45, 46 and 47 open in echelon or steps in the rear face 41 of the socket body to be of different lengths from the front face 61. The chambers are disposed at the apices of a triangle to correspond with the pins of a plug which is to be fitted to the socket.

The chambers 45, 46 and 47 each contain a first retaining means comprising two circumferentially spaced projections $\alpha$ and $\beta$, each projection being formed as a sector of the circular section of the chamber (see FIG. 3). The projections $\alpha$ and $\beta$ consequently restrict the internal aperture of each chamber. The projections $\alpha$ and $\beta$ have a longitudinal extent less than that of their respective chambers and are located remote from the body faces 41 and 61, preferably towards the central region of each chamber.

The chambers 45, 46 and 47 are intended to accommodate contact elements 81, 82 and 83 respectively (FIG. 1). The contact elements comprise flat metallic proofs, formed by pressing, stamping or otherwise, into the required shapes. Each element consists of a longitudinally extending main limb 84 to be inserted into a chamber of the body 30 and an extension limb 85 which is formed at a right angle to limb 84; the extension limb 85 is intended to project from the socket body when the contact is fitted to the body.

Figure 3E:
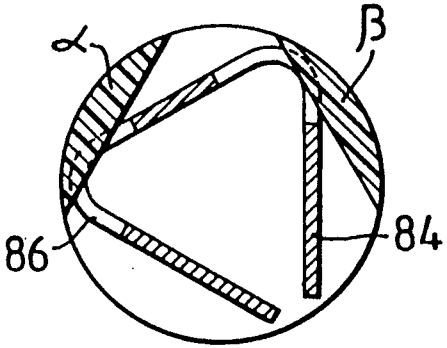
Figure 3F:
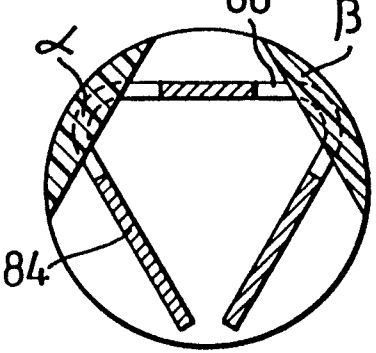
Figure 3D:
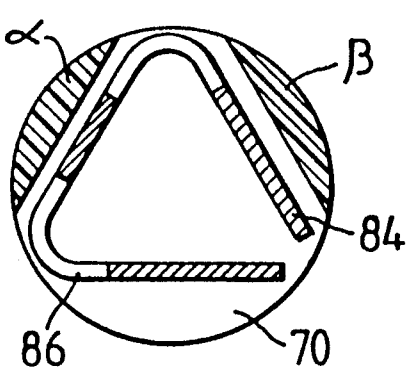

The main limb 84 is generally hollow over its longitudinal extent and of triangular form in lateral section designed to slide longitudinally into the body chambers 45, 46 and 47 when in a first orientation determined by the aperture shape 70 presented within the chamber by the projections $\alpha$ and $\beta$. A second retaining means, comprising a longitudinally extending recess is formed in the main limb 84 to provide rebates 86 which extend partway along two apices of the triangular form. The rebates 86 are complimentary in size to the chamber projections a and $\beta$ are located so as to engage the said projections when the main limb 84 of the contact element is inserted into a chamber 45, 46 or 47 and rotated about its longitudinal axis relative to the body 30, (See FIGS. 3*a*, 3*b* and 3*c*). Rotation of the contact element relative to the body causes the two sets of retaining means to move into engagement as shown in FIGS. 3*d*, 3*e* and 3*f* where 3*f* shows the main limb 84 of the contact element in a second orientation in which the rebates 86 engage with the projections $\alpha$ and $\beta$ to retain the contact element from longitudinal displacement relative to the body 30.

The extension portion 85 of the contact element, which projects from the body 30 with the contact element fitted can be bent or displaced to fit flush to the rear face 41 of the body.

The three contact elements 81, 82 and 83 vary in size so, that when fitted to their respective chamber, the tips 87 of the three extension portions 85 are co-planar although the extension portions extend in different, although parallel, planes. Further more, contact elements are shown with looped portions 88 through which the extension portion joins the main portion and it will be appreciated that characteristics are optional although convenient for connection of an electrical lead or other terminal to the contact element.

The contact elements 81, 82 and 83 are retained in their second orientation by projections 50 moulded on the rear face 41 of the body 30 and over which the extension portions 85 of the contact elements must be lifted and engaged during rotation. The projections 50 can serve to hold the extension portions 85 against the rear face 41 of the socket body.

The socket can include a spring clip element 90 (FIG. 1) formed from a flat metal proof and bent to comprise two generally parallel limbs 93 and 94; limb 94 is provided with serrated or saw toothed edges 96 and limb 93 comprises a ridge 97. This clip element 90 is inserted into socket body 30 so that the serrated edges 96 engage in opposite slots 51 and 52 in walls 53 and 54 of the socket body to frictionally retain the clip in the body. In this latter condition the ridge 97 of the clip limb 93 projects through an aperture 101 (FIG. 3B) in the socket body and into the annular recess 100. A tail section 98 of the clip element 90 extends from the body 30 and contains an aperture 99 to allow connection of an electrical (earth) lead if required.

To facilitate connection of the socket with a plug as previously described, a ridge 54 (FIG. 2A) is formed on the inner wall of the annular recess 100 to engage a complementary slot in the skirt of the plug to ensure correct orientation between the plug and the socket.

With an electrical socket assembled as described above, an electrical plug of the kind described previously can be fitted thereto. During the fitting the skirt of the plug enters the recess 100 and engages the clip element 95, pushing down its upstanding ridge 97 as the skirt passes over it until an aperture in the skirt rides over the ridge 97 which then snap engages into this said aperture to hold the skirt, and thus the plug, firmly in the socket. In this position the pins of the plug will have passed through apertures 65, 66 and 67 in the socket body and into the respective chambers of the body to be received in and engage the hollow main limbs 84 of the contact elements of the socket. The correct orientation of the pins of the plug relative to the chambers of the socket is ensured by the ridge 54 in the socket body co-operating with a complimentary slot in the skirt of said plug as previously described.

Conveniently, contact elements 81, 82 and 83 and clip element 90 are formed from appropriately profiled flat sheets of silver plated brass which are between 0.18 mm–0.42 mm thick and are simply bent into the required shapes.

It will be appreciated that various modifications may be made to the arrangements described herein without departing from the scope of the invention; for example the retaining means between body and electrical contacts can be reversed so that the chamber in the socket body are provided with longitudinally extending rebates with which complementary projections on the contact elements engage to retain the elements longitudinally in the socket body; the number of contact elements can be varied; the method of assembly of the electrical contacts can be applied to other forms of electrical connectors and with a variety of differently shaped retaining means of such contact elements.

It will be appreciated here that the particular materials used to make the socket body, the contacts and, where provided, the clip may be varied to suit particular user requirements. Furthermore it will be appreciated that the socket body may be formed as an assembly of separately made parts.

A second embodiment of the invention, which will now be described with reference to FIGS. 4 and 5, is an electrical plug. The plug has a body section 210 of moulded insulating material which comprises a generally cylindrical chamber 212 extending through it. The chamber 212 has two internal circumferentially spaced projections 214 and 215 which are sectors of the circular section. These projections 214 and 215 restrict the internal profile of the chamber and define an aperture shape similar to that shown at 70 in FIG. 3. A front aperture 218 opening to the chamber 212 is of a smaller diameter than that of the chamber. A contact element 220 for the plug has a pin 222, a retaining section 224 and a connection section 226 (which conveniently extends at right angles to the first two sections).

The longitudinally extending retaining section 224 is solid and of generally triangular section a longitudinal rebate 230 formed in a face thereof to extend along at least one apex of the triangular section. Projecting longitudinally from this triangular section is the cylindrical pin 222 which has a diameter such that it will fit closely through aperture 218. The connection section 226, comprises a flat limb at right angles to the retaining section 224, so as to lie against the external face of the plug body 210 when the contact element is fitted to the body. The connection section 226 also comprises a looped portion 232 to facilitate connection of an electrical lead thereto.

The contact element 220 is inserted into the body chamber 212 in a first orientation determined by the internal chamber projections 214 and 215 so as to allow its triangular section 224 to fit through the aperture formed by the said projections and the pin 222 to extend from the body through the aperture 218. The triangular retaining section 224 is restrained by the small diameter aperture 218 so the contact element is positioned for the two retaining means, (that is the chamber projections 214 and 215 and the rebate 230) to coincide. Rotation of the contact element about its longitudinal axis relative to the body and from its first orientation (FIG. 5*a*) to a second orientation (FIG. 5*b*) will then engage retaining means to secure the contact element longitudinally in the body. The connection section 226 of the contact element can lie against the rear face of the body 210 when the said element is fitted to the body. The contact element can be retained in its second orientation by a retaining clip 235 on the outer face of the body over which the section 226 has to be lifted and engaged during rotation.

In the above described embodiments each chamber of the connector body is provided with two circumferentially spaced internal projections, it will be appreciated that a single such projection or three or more circumferentially spaced projections can be used with appropriate modification of the contact element for it to engage therewith when rotated to its second orientation.

We claim:

1. An electrical connector comprising a body in which an electrical contact element is retained in a longitudinal chamber extending within the body, said body having a first retaining means which engages a second retaining means integrally formed on the contact element when received in the chamber, said engagement between the first and second retaining means being effected by inserting the element longitudinally into the chamber in a first orientation and rotating the element about its longitudinal axis and relative to the body to a second orientation in which the contact element is restrained from longitudinal displacement relative to the body, and said body comprising an integrally formed third retaining means which is engageable by an integral extension of the contact element in its second orientation to restrain said contact element from rotating relative to the body.

2. An electrical connector as claimed in claim 1 and in the form of a plug in which the contact element or elements comprise a longitudinally projecting pin for mating with an electrical socket.

3. An electrical connector as claimed in claim 1 in which one of the first or second retaining means comprises a projection and the other of said retaining means comprising a rebate corresponding to the projection, said projection and rebate being moved into engagement by said rotation of the contact element from its first to its second orientation to restrain the element from longitudinal displacement relative to the body.

4. An electrical connector as claimed in claim 3 in which the electrical contact element comprises a longitudinal main limb received within the chamber and an extension or terminal portion which projects from the chamber.

5. An electrical connector as claimed in claim 4 wherein the electrical contact element comprises a terminal loop portion which extends from the body to facilitate connection of an electrical lead thereto.

6. An electrical connector as claimed in claim 5 in which the first retaining means is located in the chamber.

7. An electrical connector as claimed in claim 6 wherein the electrical contact element which is received in the chamber is of substantially triangular shape in lateral section and has a longitudinally extending rebate formed along at least one apex of the triangular formation which said rebate is engagable with a corresponding projection in the chamber to restrain the contact element from said longitudinal displacement when the contact element is rotated from its first orientation to its second orientation.

8. An electrical connector as claimed in claim 7 comprising two or more contact elements retained one each in a spaced array of longitudinal chambers by respectively associated first and second retaining means.

9. An electrical connector as claimed in claim 8 comprising a plurality of chambers of different lengths so that extension portions of the contact elements received therein can extend in parallel, but different planes.

10. An electrical connector as claimed in claim 9 wherein the extension portion of the contact elements have free ends or tips thereof substantially co-planar.

11. An electrical connector as claimed in claim 10 and in the form of a socket in which the contact element or elements comprise tubular or hollow portions for receiving a pin of an electrical plug mated therewith.

12. A method of assembling an electrical connector having an insulating body and a longitudinal chamber therein opening to a rear face of the body and in which said chamber receives an electrical contact element which comprises inserting the contact element longitudinally into the chamber in a first orientation and rotating said element about its longitudinal axis and relative to the body to a second orientation in which first retaining means on the element engages second retaining means on the body for said engagement to restrain the element from longitudinal displacement relative to the body, and engaging an integral part of the contact element with a third retaining means integral with the body, by rotating the contact element to its second orientation, to retain said element from rotating relative to the body.

13. An electrical connector comprising a body in which an electrical contact element is retained in a longitudinal chamber extending within the body, said body having a first retaining means which engages a second retaining means on the contact element when received in the chamber, said engagement between the first and second retaining means being effected by inserting the element longitudinally into the chamber in a first orientation and rotating the element about its longitudinal axis and relative to the body to a second orientation in which the contact element is restrained from longitudinal displacement relative to the body, wherein one of the first or second retaining means comprises a projection and the other of said retaining means comprises a rebate corresponding to the projection, said projection and rebate being moved into engagement by said rotation of the contact element from its first to its second orientation to restrain the contact element from longitudinal displacement relative to the body, and wherein said first retaining means is located in the chamber;

a third retaining means which is engageable between the contact element and the body when said element is in its second orientation, to restrain said contact element from rotating relative to the body, said third retaining means further comprising a retaining means on the body which is engageable by an extension of the contact element in its second orientation;

said electrical contact element further comprising a longitudinal main limb received within the chamber and an extension or terminal portion which projects from the chamber, a terminal loop portion which extends from the body to facilitate connection of an electrical lead thereto, wherein the electrical contact element which is received in the chamber is of substantially triangular shape in lateral section and has a longitudinally extending rebate formed along at least one apex of the triangular formation which said rebate is engageable with a corresponding projection in the chamber to retrain the contact element from said longitudinal displacement when the contact element is rotated from its first orientation to its second orientation.

14. An electrical connector as claimed in claim 13 comprising two or more contact elements retained one each in a spaced array of longitudinal chambers by respectively associated first and second retaining means.

15. An electrical connector as claimed in claim 14 comprising a plurality of chambers of different lengths so that extension portions of the contact elements received therein can extend in parallel, but different planes.

16. An electrical connector as claimed in claim 14 wherein the extension portion of the contact elements have free ends or tips thereof substantially co-planar.

17. An electrical connector as claimed in claim 16 and in the form of a socket in which the contact element or elements comprise tubular or hollow portions for receiving a pin of an electrical plug mated therewith.

18. An electrical connector as claimed in claim 17 and in the form of a plug in which the contact element or elements comprise a longitudinally projecting pin for mating with an electrical socket.

* * * * *